US006772771B2

(12) United States Patent
Cai et al.

(10) Patent No.: US 6,772,771 B2
(45) Date of Patent: Aug. 10, 2004

(54) DECOKE ENHANCERS FOR TRANSFER LINE EXCHANGERS

(75) Inventors: Haiyong Cai, Calgary (CA); Michael C. Oballa, Cochrane (CA); Andrzej Krzywicki, Calgary (CA); Ted Magtanong, Sarnia (CA); Les Benum, Red Deer (CA)

(73) Assignee: Nova Chemicals (International) S.A. (CH)

( * ) Notice: Subject to any disclaimer, the term of this patent is extended or adjusted under 35 U.S.C. 154(b) by 313 days.

(21) Appl. No.: 10/108,519

(22) Filed: Mar. 28, 2002

(65) Prior Publication Data

US 2003/0183248 A1 Oct. 2, 2003

(51) Int. Cl.[7] ..... B08B 3/08; C10G 9/16

(52) U.S. Cl. ..... 134/22.16; 134/22.1; 134/22.17; 134/2; 208/48 R; 208/48 AA

(58) Field of Search ..... 134/22.1, 22.13, 134/22.16, 22.17, 22.19, 2, 3; 208/48 R, 48 AA; 585/950, 648

(56) References Cited

U.S. PATENT DOCUMENTS

| | | | | |
|---|---|---|---|---|
| 2,063,596 A | | 12/1936 | Feiler | 196/133 |
| 3,661,820 A | | 5/1972 | Foreman et al. | 260/22 A |
| 4,014,804 A | * | 3/1977 | Anderson | 510/270 |
| 4,290,819 A | * | 9/1981 | Cornwall et al. | 134/3 |
| 4,364,775 A | * | 12/1982 | Starkovich | 134/3 |
| 4,555,326 A | | 11/1985 | Reid | 208/48 R |
| 4,666,625 A | * | 5/1987 | Shaer et al. | 134/22.14 |
| 4,680,421 A | | 7/1987 | Forester et al. | 585/648 |
| 4,724,064 A | | 2/1988 | Reid | 208/48 |
| 4,889,146 A | | 12/1989 | Beal | 134/64 |
| 5,118,356 A | * | 6/1992 | Darmon et al. | 134/3 |
| 5,330,970 A | | 7/1994 | Reid et al. | 507/90 |
| 5,630,887 A | | 5/1997 | Benum et al. | 148/280 |
| 5,648,178 A | | 7/1997 | Heyse et al. | 428/627 |
| 6,228,253 B1 | | 5/2001 | Gandman | 208/48 |

FOREIGN PATENT DOCUMENTS

| | | |
|---|---|---|
| FR | 2.202.930 | 2/1972 |
| RU | 2168533 | 6/1999 |

* cited by examiner

*Primary Examiner*—Frankie L. Stinson
*Assistant Examiner*—Saeed Chaudhry
(74) *Attorney, Agent, or Firm*—Kenneth H. Johnson

(57) ABSTRACT

In a steam cracking operation the formation of coke is a problem which needs to be overcome. While significant work has been done on decoking of furnaces little work has been done regarding transfer line exchangers. Coking of transfer line exchangers (TLE) may be reduced by injection of a solution containing at least one group 1 or 2 metal dichromate or dichromate and one or more of a group 1, 2 or 7 metal carbonate into the TLE.

33 Claims, 1 Drawing Sheet

DECOKE ENHANCERS FOR TRANSFER LINE EXCHANGERS

FIELD OF THE INVENTION

Figure 1:
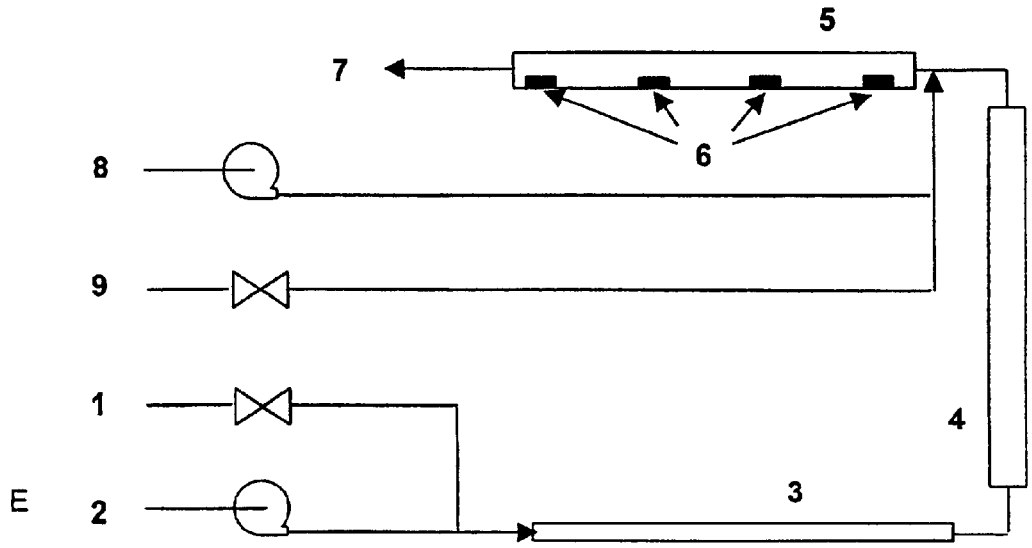

The present invention relates to compositions and methods for accelerating decoke operation of transfer line exchangers (TLE) in steam crackers for olefin production. Particularly, the compositions and methods disclosed relate to introducing decoke enhancers by atomized injection into TLE inlet cone before and/or during furnace decoke operation. More particularly, the decoke enhancers are aqueous solutions of metal chromates and dichromates, or metal manganates and permanganates, or metal carbonates, or metal acetates and oxalates, or metal hydroxides, or their mixtures thereof. Additionally, the said compositions and methods are applicable to both shell-and-tube and double-pipe TLE's which are commonly used in steam crackers for olefin production.

BACKGROUND OF THE INVENTION

In a typical steam cracking furnace, a cracked hydrocarbon stream leaves furnace coils at a temperature ranging from 750 to 850° C. and enters immediately the TLE's, where the hot process stream is cooled rapidly from typically 750° C. to about 300° C. There are two types of TLE's which are very commonly used in industrial steam crackers for ethylene production: shell-and-tube TLE's and double-pipe TLE's. A shell-and-tube TLE has three main sections: the entrance cone, the tubesheet and tubes, and the exit cone, while a double-pipe TLE has mainly one section of a-pipe-in-a-pipe configuration.

Coke deposition in steam cracking furnaces is an inevitable process, reflecting the chemistry and nature of cracking reactions of hydrocarbons. Although coke deposition occurs in furnace coils, especially in the high temperature radiant section, it also happens in TLE's operated at lower temperatures. Particularly, coke deposition can become a very severe problem in a shell-and-tube TLE due to its geometric configuration. Additionally, with heavy feedstocks such as naphtha, the low operating temperatures (650–300° C.) in a TLE can induce substantial condensation of high boiling components from the cracked hydrocarbon stream. Then, the formed condensates in TLE can undergo a dehydrogenation process and form solid coke deposits.

Due to the inevitable coke build-up in the radiant coil and TLE's, steam cracking furnaces can normally operate for typically 20–60 days and a decoke operation has to take place to remove the coke deposits. A typical decoke operation involves passing air and steam through the furnace coils and TLE's which are maintained at more or less the same temperature range as during cracking operation. After 2–3 days, the coke deposits in the furnace coils can be removed (combusted or gasified) almost completely. However, for TLE's, such decoke operation often can not remove the coke deposits completely since the TLE operating temperatures are too low for combustion/gasification reactions to proceed to completion. Therefore, coke deposits accumulate fairly rapidly in TLE's and after a few cycles of coking-decoking operation (typically 3–4 months), the TLE's together with the whole furnace must be brought offline, cooled and the TLE's must be cleaned mechanically. This operation not only requires high maintenance costs but also cause interruptions to production for typically about 4–10 days. The present invention discloses a method to accelerate decoke operation for TLE's as well as the compositions of the decoke enhancers. Therefore, the overall TLE run length before a mechanical decoke can be prolonged and very likely mechanical decoke for the TLE can be eliminated. In addition, the injected decoke enhancer can also reduce coke formation in the TLE during the subsequent cracking operations and therefore extend the overall runlength of a steam cracker.

To date, different inhibitors to reduce coke formation in the furnace coils have been patented [U.S. Pat. No. 6,228,253 of Zalman Gandman, U.S. Pat. Nos. 4,889,146 and 4,680,421 of David Forester, U.S. Pat. Nos. 5,330,970 and 4,724,064 of Dwight Reid]. Reports on accelerators to gasification of coke in furnace coils can also be found in literatures [Dave Kesner et al, Chemical Technology Europe, Sep/Oct. 94, pp14–16, and S. E. Babash et al, PTQ Autumn 99, pp113–120]. However, there is hardly any prior art available on decoke enhancers for TLE's.

U.S. Pat. No. 6,228,253 issued May 8, 2001 to Zalman Gandman discloses an injection nozzle for injecting additives into the coils of a pyrolysis furnace. The body of the specification discloses injecting salts of group IA (group 1) and group IIA (group 2) in a polar solvent into the coils. The patent discloses the salts may be tetrasilicates, tetraborates, pentaborates, borates, nitrates, potassium liquid glass and boric acid. The patent fails to teach the use of chromate salts or carbonates as required in the present invention. Further the patent does not disclose or suggest injecting such mixtures into transfer line exchangers.

U.S. Pat. No. 4,889,146 issued Dec. 26,1989 to Betz Laboratories, Inc. discloses treating pyrolytic reactors and furnaces with alkali metals, preferably magnesium, acetates, chlorides and nitrates and magnesium sulfate. The reference fails to teach the use of group 1 or 2 chromates and dichromates nor does the reference relate to treating transfer line exchangers.

U.S. Pat. No. 5,330,970 issued Jul. 19, 1994 to Betz Laboratories teaches that a mixture of a boron compound and a dihydroxybenzene compound may be added to the steam or feedstock to a heated metal surface to reduce or inhibit coke formation. The boron compound may be ammonium borate, biborate, pentaborate, boron oxide or sodium borate. The dihydroxybenzene compound may be hydroquinone, resorcinol, catechol, or 4-tert-butyl resorcinol. The mixture may be added to the steam or the feedstock. The reference fails to teach the use of group 1 or 2 metal chromates and dichromates nor does the reference teach the application of these types of systems to transfer line exchangers.

There are a number of patents which teach the use of boron compounds to inhibit coke formation on heated metal surfaces, typically at about 1600° F. (about 870° C.) including boron, boron oxides or metal borides (U.S. Pat. No. 4,555,326) boron oxides, metal borides, and boric acid (U.S. Pat. No. 4,724,064) ammonium borate U.S. Pat. No. 4,680,421); and boric acid, boric oxide and borax (U.S. Pat. No. 3,661,820). These patents fail to teach the use of the chromate and dichromate compounds of the present invention and fail to teach the use of such compounds in decoking transfer line exchangers.

Chemical Abstract Vol. 83; 30687k (of French Patent 2,202,930) teaches adding molten oxides or salts of group III (now 13), IV (now 14) and VIII (now 8, 9, and 10). The abstract does not disclose the use of the metal chromates and dichromates of the present invention nor does the abstract disclose the treatment of transfer line exchangers.

U.S. Pat. No. 2,063,596, issued Dec. 8, 1936 to I. G. Farbenindustrie Aktiengesellschaft discloses exposing compounds such as molybdenum carbonyl, tetra ethyl lead and chromyl chloride to temperatures above which they decompose to help reduce coke formation on metal surfaces. The patent does not teach the chemicals required in the present invention.

U.S. Pat. No. 5,648,178 issued Jul. 15, 1997 to Chevron Chemical Company teaches treating or coating (painting) the internal surface of a reactor system with a group VI B (now group 6) metal layer. A particularly useful metal is chromium and the chloride forms appear to be particularly useful in the paint. The patent fails to teach the group 1 or 2 metal chromates and dichromates of the present invention.

There are several papers by VNIIOS in 1994 and 1999 relating to inhibitors for coke build up in a furnace using group 1 and 2 metal acetates, carbonates, nitrates and sulphates and compounds of sulphur, phosphorous, boron, aluminum, silicon, tin antimony, lead, cadmium, siloxane, derivatives of monocarboxylic and alkylsulphonic acids. The inhibitor is continuously injected into the hydrocarbon process stream prior to the cracking section. VNIIOS also has a paper (Chem. Tech. Eur. September 1994, pp14–16) which discloses an accelerated decoking method for hydrocarbon furnace coils. The methods were developed for vinyl chloride (VCM) plants, but it was claimed to be applicable to furnace tubes of other plants where coke buildup is a problem. This process differs from conventional chemical cleaning methods because it uses an endothermic reaction and is carried out in the absence of air. Therefore, coke removal is achieved through catalytic gasification reactions, instead of combustion.

A Russian patent R.U. 2168533, issued Oct. 6, 2001 to V. A. Bushuev, reveals a periodical non-stop decoking process for tubular pyrolysis furnace coils. The process consists of two periods without switching the furnace train to decoke mode. In the first period—hydrocarbon cracking, the first additive is introduced into hydrocarbon feed which optionally may contain sulfur. Typical additive components are phosphorous-containing or sulfur-containing compounds, such as $KH_2PO_4$, $H_3PO_4$, or DMS. During the second period—coil decoking, another additive containing either alkali or alkali-earth metal compounds, such as $MgCl_2$, $MgSO_4$, $Mg(OCOCH_3)_2$ is introduced into hydrocarbon feed to promote online coke gasification from the coil surfaces. Again, this invention fails to reveal the use of group 1 or 2 metal chromates or dichromates to enhance decoke operation in TLE.

SUMMARY OF THE INVENTION

The present invention provides a process of treating transfer line exchangers in an ethylene cracker comprising injecting up to 15 wt % based on the stream entering the transfer line exchanger of a solution consisting of a polar solvent and up to 80 weight % of a solute composition comprising (i) from 10 wppm to 100 wt % of one or more group 1 or 2 metal chromates and dichromates;
(ii) from 0 wppm to 40 wt % of one or more group 1, 2 and 7 metal carbonates;
(iii) from 0 to 30 wt % of one or more group 1 or 2 manganates or permanganates;
(iv) from 0 to 20 wt % of one or more group 1 and 2 metal acetates and oxalates;
(v) from 0 to 1 wt % of one or more group 6 or 7 acetates or oxalates; and
(vi) from 0 to 1 wt % of one or more group 1 and 2 metal hydroxides, into a carrier stream comprising an inert gas, or air, or process steam or mixtures thereof injected at one or more points between the outlet of the radiant coils and the inlet of said transfer line exchanger at a temperature from 300° C. to 750° C. during a decoking operation of said ethylene cracker for a period of time not less than 1 second.

DETAILED DESCRIPTION

FIG. 1 is a schematic drawing of the device to conduct the lab scale experiments.

In steam cracking of hydrocarbon feedstocks typically the product stream leaves the furnace and enters the transfer line exchangers ("TLE's") which are normally made of lower grade metals such as carbon steel. During normal operation there is a build up of coke in the transfer line exchanger. There are technologies that permit furnace tubes to be operated for longer periods of time before decoking (e.g. U.S. Pat. No. 5,630,887). However, the transfer line exchanger is not decoked until the furnace tube is decoked. Accordingly there is a need for methods to decoke the transfer line exchanger faster and cleaner and to reduce the coke build up in a transfer line exchanger.

During steam cracking operation (e.g. normal operation) the transfer line exchanger may be operated at a temperature from about 300° C. to about 650° C. During decoking, the transfer line exchanger may be held at temperatures from 300° C. to 750° C., preferably from 450° C. to 750° C.

At such a temperature range, the desired combustion and gasification reactions to remove coke deposits do not normally proceed at a fast rate. Therefore, introduction of disposable catalysts (decoke enhancers) to accelerate these reactions at such low temperatures becomes necessary.

The decoking compositions of the present invention may comprise up to six groups of components. One of the groups of components is essential (e.g. component (I)) and there are up to five optional groups of components (e.g. components (ii), (iii), (iv), (v) and (vi) although it is preferred that component (ii) be present).

The essential component is one or more group 1 or 2 (formerly group IA or IIA) metal chromates and dichromates. Preferably these salts are selected from the group consisting of $Li_2CrO_4$, $K_2CrO_4$, $Na_2CrO_4$, $BaCrO_4$, $Ba_3(CrO_4)_2$, $MgCrO_4$, $CaCrO_4$, $Cs_2CrO_4$, $Li_2Cr_2O_7$, $K_2Cr_2O_7$, $Na_2Cr_2O_7$, and $Cs_2Cr_2O_7$. The chromates and dichromates may be used in an amount from 10 parts per million by weight (wppm) to 80 wt %, preferably from 50 wppm to 30 wt %, most preferably from 100 wppm to 15 wt % of the solute composition.

The compositions of the present invention may comprise up to five optional groups of components selected from the group consisting of (ii) from 0 wppm to 40 wt % of one or more group 1, 2 and 7 metal carbonates;
(iii) from 0 to 30 wt % of one or more group 1 or 2 manganates or permanganates;
(iv) from 0 to 20 wt % of one or more group 1 and 2 metal acetates and oxalates;
(v) from 0 to 1 wt % of one or more group 6 or 7 acetates or oxalates; and
(vi) from 0 to 1 wt % of one or more group 1 and 2 metal hydroxides.

The one or more group 1, 2 and 7 metal carbonates may be selected from the group consisting of $K_2CO_3$, $Na_2CO_3$, $MgCO_3$, $CaCO_3$, and $MnCO_3$. The carbonates may be used in the solute in an amount from 5 wppm to 40 wt %, preferably from 50 wppm to 10 wt %, most preferably from 100 wppm to 5 wt %.

The one or more group 1 or 2 manganates or permanganates may be selected from the group consisting of potassium manganate ($K_2MnO_4$), potassium permanganate ($KMnO_4$), sodium manganate ($NaMnO_4$), and magnesium permanganate (hexahydrate) ($Mg(MnO_4)_2 \cdot 6H_2O$). The group 1, 2 or 7 manganates or permanganates may be used in the solute in an amount from 0 to 30 wt %, preferably from 1 wppm to 15 wt %, most preferably from 10 wppm to 5 wt %.

The one or more group 1 and 2 metal acetates and oxalates may be selected from the group consisting of potassium acetate ($KC_2H_3O_2$), calcium acetate ($Ca(C_2H_3O_2)_2$), potassium oxylate ($K_2C_2O_4$), and calcium oxylate $CaC_2O_4$. The group 1 and 2 metal acetates and oxylates may be used in the solute in amounts from 0 to 20 wt %, preferably from 20 wppm to 10 wt %, most preferably from 100 wppm to 1 wt %.

The one or more group 6 or 7 acetates or oxalates may be selected from the group consisting of manganese (II) acetate tetrahydrate ($Mn(C_2H_3O_2)_2 \cdot 4H_2O$), manganese (II) oxalate dihydrate ($MnC_2O_4 \cdot 2H_2O$), chromium (II) acetate monohydrate ($Cr(C_2H_3O_2)_2 \cdot H_2O$), and chromium oxalate monohydrate ($CrC_2O_4 \cdot H_2O$). The group 6 or 7 acetates or oxalates may be used in the solute in amounts from 0 to 10,000 wppm, preferably from 1 to 1,000 wppm, most preferably from 5 to 500 wppm.

The one or more group 1 and 2 metal hydroxides may be selected from the group consisting of NaOH and KOH although other hydroxides are available. The hydroxides may be used in the solute in amounts from 0 to 1 wt %, preferably less than 1000 wppm, most preferably less than 100 wppm.

The above components are dissolved in a polar solvent, preferably water to provide a solution comprising up to 80 wt % of solute, preferably less than 30 wt %, most preferably less than 15 wt % of solute. Typically the solute is present in the solution in an amount not less than 100 wppm.

The resulting solution is used during the decoking operation of an ethylene furnace to accelerate (catalyze) the rate of decoking of a transfer line exchanger. As an additional benefit the treatment retards the formation of coke in a transfer line exchanger treated in accordance with the present invention. The solution may be introduced at one or more points between the outlet of the radiant coils and the inlet of the transfer line exchanger in several manners. The solution could be atomized into a carrier gas and injected just upstream of the inlet of the transfer line exchanger. If the solution is atomized in a stream injected upstream of the inlet to the transfer line exchanger the carrier gas may be air, steam or an inert gas such as nitrogen or a mixture thereof. Preferably the carrier gas is nitrogen. The solution is injected to provide up to 15 wt %, preferably from 5 wppm to 15 wt %, most preferably from 10 to 12000 wppm, desirably from 50 to 1000 wppm based on the decoking stream entering the transfer line exchanger.

The process may be a continuous process conducted over the duration of the decoking process. The process may be pulsed. One or more pulses of solution is injected into the transfer line exchanger during the first part of the decoking operation before an oxidizing atmosphere such as air is introduced into the transfer line exchanger. Typically one, but possibly more than one pulse is introduced into the transfer line exchanger shortly before the decoking operation terminates.

In the pulsed mode of operation the time for introducing the solution into the transfer line exchanger (e.g. one or more pulses) may range up to about 120 minutes or more. Generally, under typical conditions the time of treatment should not be less than 1 second. The time may be split so that from 25 to 100%, preferably from 30 to 70% of the time for introducing the solution into the transfer line exchanger is prior to the introduction of the oxidizing atmosphere (e.g. air) during the decoking operation and the balance 75 to 0%, preferably from 70 to 30% of the time occurs (shortly) before termination of the decoking operation. The duration of the injection may be as short as 1 second for high injection rates of high concentration solutions (e.g. 15 wt % injection rate of an 80 wt % solution) or at lower injection rates and concentrations (e.g. injection rate of less than 12000 wppm of a 15 wt % and lower solution) typically not less than about 10 seconds.

The present invention will now be illustrated by the following non-limiting examples.

EXAMPLES

The reactor used for testing of the decoke enhancers is shown in FIG. 1. Typically, hydrocarbon feeds are introduced into the reactor through a flow control system 1. A metering pump 2 delivers the required water for steam generation in a preheater 3 typically operating at about 300° C. The vaporized hydrocarbon stream then enters a tubular quartz reactor tube 4 typically heated at about 900° C., where steam cracking of the hydrocarbon stream takes place to make pyrolysis products. The product stream then enters a quartz tube 5 which simulates the operation of a transfer line exchanger. This transfer line exchanger was designed and calibrated in such a way that metal coupons 6 can be placed at locations where temperatures are known. Typically, metal coupons are located at the positions where the temperature is 650° C., 550° C., 450° C. and 350° C. Coupons are weighed before and after an experiment to determine changes in weight. The coupon surfaces can be examined to determine morphology and composition. After the transfer line exchanger 5, the process stream 7 enters a product knockout vessel (not shown) where gas and liquid samples can be collected for further analyses. In the reactor unit, another metering pump 8 is used to deliver decoke enhancer solution of the present invention at precise flow rates and a gas control system 9 to disperse the enhancer solution at the inlet of the transfer line exchanger 5.

For decoke experiments, air enters at a controlled flow rate of 2 standard liters per minute (slpm), replacing hydrocarbon feeds, through the feed delivery system 1. Water is also admitted, through the metering pump 2, into the preheater where steam is generated. The tubular furnace 4 operates at again typically 900° C. and transfer line exchanger 5 maintains a temperature profile from 700° C. to 300° C. Coke samples are placed at the temperature locations of 650° C., 550° C. and 450° C. In the decoke experiment, the coke samples used can be either ground coke particles, coke chips directly from an ethylene plant transfer line exchanger or coke deposits formed in situ on the surfaces of the metal coupons during a previous cracking experiment.

In the experiments the following agents were used

NDE1 was an aqueous solution containing: 200 wppm of $Ba_3(CrO_4)_2$, 800 wppm of $K_2CrO_4$, 3000 wppm of $K_2Cr_2O_7$, 200 wppm of $MgCO_3$, 5 wppm of $CaCO_3$, 5 wppm of $CaC_2O_4.H_2O$ and 25 wppm of KOH NDE2 was an aqueous solution containing: 300 wppm of $Cs_2CrO_4$, 500 wppm of $K_2CrO_4$, 3000 wppm of $K_2Cr_2O_7$, 500 wppm of $MgCO_3$, 5 wppm of $Ca(C_2H_3O_2)_2$, 400 wppm of $Mg(MnO_4)_2$, 500 wppm of $KMnO_4$ NDE3 was an aqueous solution containing: 2000 wppm of $K_2Cr_2O_7$, 500 wppm of $MgCO_3$, 300 wppm of $Ca(C_2H_3O_2)_2$, 500 wppm of $KMnO_4$

Example 1

Decoke Test in a Thermobalance

Plant TLE coke deposits were crushed into small coke particles (2–5 mm). The coke particles were then impregnated with a decoke enhancer (NDE1, NDE2 or NDE3) at various concentrations up to 3190 wppm of the coke sample weight. Decoke tests were carried out in a commercial thermal balance operating at 600° C. A typical sample size of 10 mg was used for the tests and an air flow of 50 standard cubic centimeters per second (sccm), saturated with 60° C. water vapor, was used to decoke the sample. Baseline runs, without the enhancer loading, were also carried out under the identical conditions. The results are shown in Table 1.

TABLE 1

| Coke sample | Enhancer loading (wppm of sample) | Time for 50 wt % Decoke (min) |
|---|---|---|
| TLE coke | 0 | 100.6 |
| TLE coke + NDE1 | 50 | 80.4 |
| TLE coke + NDE1 | 100 | 64.2 |
| TLE coke + NDE1 | 300 | 45.1 |
| TLE coke + NDE1 | 500 | 34.7 |
| TLE coke + NDE1 | 1662 | 21.1 |
| TLE coke + NDE2 | 100 | 83.03 |
| TLE coke + NDE2 | 1663 | 20.41 |
| TLE coke + NDE3 | 3190 | 12.0 |

The results clearly show that any one of these three tested enhancers can accelerate the decoking process. For NDE1 and NDE2, the time for 50% decoke can be as short as ⅕ of the time for the baseline run test. With NDE3 at a higher impregnation concentration, the time for 50% decoke is just ⅛ of the time for the baseline run. Based on these results, the enhancers loaded at concentrations even higher than indicated in the table are likely to further accelerate the decoking process.

Example 2

Decoke Tests with Preloaded Enhancer Using the TLE Testing Unit

The same coke sample, as used in Example 1, was used for further tests using the TLE testing unit (FIG. 1). Three quartz boats, containing coke samples of typically 1.0 gram each, were located at the pre-calibrated temperature points, 650° C., 550° C. and 450° C., in the TLE tube 5. The coke samples were impregnated with the decoke enhancer NDE2 at a concentration from 100 to 1600 wppm of the coke sample weight. Prior to the decoke test, the furnace of TLE testing unit was heated to 900° C. with a flow of $N_2$ at 6 slpm and steam at 10 cc/min entering the TLE. Once the TLE temperatures reached the required profile, $N_2$ was reduced from 6 slpm to 2 slpm and air introduced at 2 slpm to start the decoke test. The water remained at the same feeding rate.

After 3 hours of decoke, furnace heating was stopped and air and water feeds were shutdown. $N_2$ flow was increased from 2 slpm to 6 slpm to cool the TLE tube to room temperature. The coke sample residues were then taken out and weighed to determine the weight loss. The results are shown in Table 2.

TABLE 2

| Enhancer loading conc. (wppm of coke sample) | Coke weight loss, wt % | | | |
|---|---|---|---|---|
| | At 450° C. | At 550° C. | At 650° C. | Total |
| 0 (baseline) | 1.2 | 6.1 | 37.5 | 14.9 |
| 100 | 1.0 | 4.9 | 37.8 | 14.2 |
| 300 | 2.0 | 8.1 | 44.0 | 18.0 |
| 700 | 2.3 | 11.5 | 51.4 | 21.7 |
| 1100 | 3.4 | 12.4 | 58.6 | 26.6 |
| 1600 | 5.7 | 15.7 | 68.6 | 31.0 |

It is clear that NDE2 enhancer accelerates the decoke process at tested TLE temperatures. At 650° C., the coke weight loss increased with increasing NDE2 loading concentration. Up to 1600 wppm loading, the coke weight loss is 83% higher than the baseline. At the other two TLE temperature locations, the increases in weight loss are lower. However, the relative increases (in terms of percentage changes) are higher: 370% and 160% higher than their baseline numbers, respectively. This indicates that decoke enhancement at lower temperatures is more significant in relative teams, and this is consistent with basic principles of catalysis.

Example 3

Decoke Tests with Enhancer Injection

Plant TLE coke deposits were cut into flat coupons whose external surface areas can be measured. These coke coupons were then placed at the 650° C., 550° C. and 450° C. locations in the TLE tube 5. The same procedure, as in Example 2, was used to heat up the TLE tube to the desired temperature profile. The decoke enhancer NDE2 (1000 wppm aqueous solution) was, then, delivered through a metering pump 8 at 2 cc/min into the injection port. At the same time, $N_2$ was admitted through the gas delivery system 9 at 5 slpm into the injection port to disperse the NDE2 solution into the TLE tube 5. After 10 minutes of injection, both NDE2 solution and the $N_2$ were shut down. However, the $N_2$ and steam flows through 1, 2, 3 and 4 were maintained for about 30 minutes to allow the TLE temperature profile to re-establish. Afterwards, a decoke test was started following the same procedure as in Example 2. A baseline run, without enhancer injection, was also carried out for comparison. The results given in Table 3 are normalized for the gross or apparent surface areas of the coke chip coupons tested.

TABLE 3

| | NDE2 injection (wppm of warm-up stream) | Surface normalized decoke rate (mg/cm2/hr) | | |
|---|---|---|---|---|
| | | 450° C. | 550° C. | 650° C. |
| Baseline | 0 | 0.6 | 2.7 | 22.7 |
| Run-1 | 114 | 1.3 | 6.6 | 49.3 |
| Run-2 | 114 | 1.5 | 7.3 | 52.9 |

Run-1 and run-2, carried out under identical cracking conditions, were duplicate runs for the confirmation of experimental repeatability. The results show that decoking rates increase by at least 100% for all three TLE temperatures at tested injection rate of NDE2 enhancer. It is, however, believed that further improvement in decoking rate can be reached with further increase of NDE2 injection concentration, either by increasing NDE2 enhancer concentration or by extending injection duration.

Example 4

Composition Changes of Carbon Steel Surfaces

Two sets of carbon steel coupons (2½ wt %Cr, 1 wt % Mo), a typical metal for ethylene plant TLE's, were used in coking-decoking experiments for comparison. The coking test was carried out in the TLE testing unit for 16 hours. Ethane was used as feedstock entering the reactor at 4.3 slpm and steam dilution ratio was at 0.3 w/w, with a residence time of about 1 second. After the coking period, $N_2$ and steam were admitted into the TLE test unit to establish the temperature profile for the decoking period. The experimental parameters for the decoking period were previously given in Example-3. With one set of coupons, this full coking-decoking cycle was done as a baseline case, whilst with the other set of coupons the decoke enhancer NDE2 was injected prior to decoking at about 60 wppm of the process stream for 10 mins. An additional injection of the same dose took place in the middle of the decoking period (at 1.5 hr for 10 mins). After the completion of the whole coking-decoking experiment, both sets of coupons were taken out for determination of their surface compositions. The results are given in Table 4. Additionally, the composition of a fresh metal coupon is also listed for comparison.

TABLE 4

| | Surface composition (wt %) | | | | | | | | |
|---|---|---|---|---|---|---|---|---|---|
| Coupon | C | O | Mg | Si | K | Cr | Mn | Fe | |
| Base Metal | 0.82 | | | 0.15 | | 2.35 | 0.56 | 95.23 | 0. |
| Baseline Run (TLE 450° C.) | 0.94 | 1.89 | | | | 0.79 | 0.70 | 95.61 | |
| Baseline Run (TLE 550° C.) | 0.79 | 1.96 | | 0.19 | | 0.43 | 0.77 | 95.77 | |
| Baseline Run (TLE 650° C.) | 0.83 | 1.78 | | 0.15 | | 0.26 | 0.91 | 95.96 | |
| NDE2 Injected (TLE 450° C.) | 2.94 | 1.52 | | | | 0.74 | 0.70 | 94.01 | |
| NDE2 Injected (TLE 550° C.) | 0.81 | 2.03 | | 0.21 | 0.14 | 0.91 | 0.84 | 95.06 | |
| NDE2 Injected (TLE 650° C.) | 1.34 | 1.38 | 0.37 | 0.30 | 20.10 | 12.88 | 0.64 | 59.63 | 3. |

Comparing the surface compositions of metal coupons between the baseline run and the base metal, oxygen content became obviously higher after the coking-decoking cycle. The main metal element Fe and some of the minor elements, such as Si and C remain relatively unchanged. However, Cr concentration is seen to drop substantially from the base metal to the coupons for the baseline run. Further, the decrease in Cr concentration continues as coupon temperature rises from 450 to 650° C. Mn is seen to increase marginally, and Mo became not measurable.

From the NDE2 injection experiment, there are four major changes:

1. The surface concentrations of elements, such as Cr, Mo, Mn and Si, increased
2. Elements, which promote coke gasification/decoke, such as K and Mg, are seen to increase. In some cases, e.g., on the coupon placed at 650° C., such increases are substantial.
3. The main element (Fe) is seen to decrease substantially due to the deposition of Cr and K on the coupon surfaces.
4. Oxygen concentrations increased to the similar level as for the coupons from the baseline run.

Example 5

Comparative Coking Tests of Coated Coupons

The two sets of metal coupons, as used for the experiments in Example 4, were tested again for coke make in the TLE. The purpose of these further coking tests was to determine the effect of the residual NDE2 decoke enhancer on the coke formation when these metal surfaces are exposed to hydrocarbon cracking stream again. For further comparison, results of a set of fresh coupons are also given in Table 5.

TABLE 5

| | coke make in TLE (mg/cm2) | | | |
|---|---|---|---|---|
| | 350° C. | 450° C. | 550° C. | 650° C. |
| Fresh coupons | 0.1 | 3.2 | 5.4 | 43.8 |
| Coupons used for baseline run | n/d | 2.9 | 32.0 | 123.8 |
| Coupons used for injection run | n/d | 0.0 | 6.1 | 3.1 |

Clearly, the metal coupons used for the baseline run in Example 4 produced much more coke deposits than the fresh coupons. In contrast, the set of coupons used for the injection run produced significantly less coke deposits. For the 650° C. coupon, for Example, the coke make is only 2.5% of the coke deposited on the coupon used for the baseline run in Example 4, and is about 7% of the coke formed on a fresh coupon and about 2.5% of the coke make for the conventionally decoked coupon.

What is claimed is:

1. A process of treating transfer line exchangers in steam crackers for ethylene and propylene production comprising injecting up to 15 wt % based on the stream entering the transfer line exchanger of a solution consisting of a polar solvent and up to 80 weight % a solute composition comprising;

(i) from 10 wppm to 100 wt % of one or more group 1 or 2 metal chromates and dichromates;

(ii) from 0 wppm to 40 wt % of one or more group 1, 2 and 7 metal carbonates;

(iii) from 0 to 30 wt % of one or more group 1 or 2 manganates or permanganates;

(iv) from 0 to 20 wt % of one or more group 1 and 2 metal acetates and oxalates;

(v) from 0 to 1 wt % of one or more group 6 or 7 acetates or oxalates; and (vi) from 0 to 1 wt % of one or more group 1 and 2 metal hydroxides, into a carrier stream comprising an inert gas, or air, or process steam or mixtures thereof injected at one or more points between the outlet of the radiant coils and the inlet of said transfer line exchanger at a temperature from 300° C. to 750° C. during a decoking operation of said ethylene cracker for a period of time not less than 1 second.

2. The process according to claim 1 wherein the solvent is water.

3. The process according to claim 2, wherein said one or more group 1 or 2 metal chromates and dichromates is present in said solute in an amount from 50 wppm to 30 wt %.

4. The process according to claim 3, wherein said one or more group 1 and 2 metal chromates and dichromates is selected from the group consisting of $Li_2CrO_4$, $K_2CrO_4$ $Na_2CrO_4$, $BaCrO_4$, $Ba_3(CrO_4)_2$, $MgCrO_4$, $CaCrO_4$, $Cs_2CrO_4$, $Li_2Cr_2O_7$, $K_2Cr_2O_7$, $Na_2Cr_2O_7$, and $Cs_2Cr_2O_7$.

5. The process according to claim 4, wherein said one or more group 1, 2 and 7 metal carbonates is selected from the group consisting of $K_2CO_3$, $Na_2CO_3$, $MgCO_3$, $CaCO_3$, and $MnCO_3$.

6. The process according to claim 5, wherein said one or more group 1 and group 2 metal acetates and oxalates is selected from the group consisting of $KC_2H_3O_2$, $Ca(C_2H_3O_2)_2$, $K_2C_2O_4$, $CaC_2O_4$.

7. The process according to claim 6, wherein said group 1 or 2 manganate or permangante is selected from the group consisting of $K_2MnO_4$, $KMnO_4$, $NaMnO_4$, $Mg(MnO_4)_2 \cdot 6H_2O$.

8. The process according to claim 7, wherein said group 6 or 7 acetates or oxylates is selected from the group consisting of $Mn(C_2H_3O_2)_2 \cdot 4H_2O$, $MnC_2O_4 \cdot 2H_2O$, $Cr(C_2H_3O_2)_2 \cdot H_2O$, and $CrC_2O_4 \cdot H_2O$.

9. The process according to claim 8, wherein said one or more group 1 and 2 metal hydroxides are selected from the group consisting of KOH and NaOH.

10. The process according to claim 9, wherein said transfer line exchanger is maintained at a temperature from 450° C. to 750° C.

11. The process according to claim 10, wherein said one or more group 1 and 2 metal carbonates is present in said solute in an amount from 50 wppm to 10 wt %.

12. The process according to claim 11, wherein said one or more group 1 and 2 metal chromates and dichromates is present in said solute in an amount from 100 wppm to 15 wt %.

13. The process according to claim 12, wherein said one or more group 1 and 2 metal carbonates is present in said solute in an amount from 100 wppm to 5 wt %.

14. The process according to claim 13, wherein in said carrier gas said inert gas is nitrogen.

15. The process according to claim 14, wherein said polar solution is injected into said carrier stream in an amount from 10 to 12,000 wppm.

16. The process according to claim 15, wherein said treatment time occurs continuously during the decoking of said TLE.

17. The process according to claim 16, wherein said polar solution is injected into said carrier stream in an amount from 50 to 1000 wppm.

18. The process according to claim 17, wherein components (iii), (iv), (v), and (vi) are absent.

19. The process according to claim 17 wherein at least one of component (iii), (iv), (v), and (vi) are present in amounts to provide:

(i) from 1 wppm to 15 wt % of said one or more group 1, 2 or 7 manganates or permanganates;

(ii) from 100 wppm to 1 wt % of said one or more group 1 and group 2 metal acetates and oxalates;

(iii) from 1 to 1,000 wppm of said one or more group 6 or 7 acetates or oxalates; and (iv) from 10 wppm to 100 wppm of said one or more group 1 and 2 metal hydroxides.

20. The process according to claim 19, wherein only one of components (iii), (iv), (v), and (vi) is present.

21. The process according to claim 19, wherein two of components (iii), (iv), (v), and (vi) are present.

22. The process according to claim 19, wherein three of components (iii), (iv), (v), and (vi) are present.

23. The process according to claim 19, wherein four of components (iii), (iv), (v), and (vi) are present.

24. The process according to claim 15, wherein the total time of injecting said aqueous solution into said transfer line exchanger is less than 120 minutes.

25. The process according to claim 24, wherein said aqueous solution is injected into said carrier stream in an amount from 50 to 1000 wppm.

26. The process according to claim 25, wherein components (iii), (iv), (v), and (vi) are absent.

27. The process according to claim 26, wherein the treatment is divided so that from 70 to 30% of the treatment occurs prior to the introduction of decoke air into said TLE and from 30 to 70% of the treatment occurs 120 minutes to 10 minute before the decoking operation terminates.

28. The process according to claim 25 wherein at least one of component (iii), (iv), (v), and (vi) is present in amounts to provide:

(i) from 1 wppm to 15 wt. % of said one or more group 1 or 2 manganates or permanganates;

(ii) from 100 wppm to 1 weight % of said one or more group 1 and group 2 metal acetates and oxalates;

(iii) from 1 to 1,000 wppm of said one or more group 6 or 7 acetates or oxalates; and (iv) from 10 wppm to 100 wppm of said one or more group 1 and 2 metal hydroxides.

29. The process according to claim 28, wherein the treatment is divided so that from 70 to 30% of the treatment occurs prior to the introduction of decoke air into said TLE and from 30 to 70% of the treatment occurs 120 minutes to 10 minute before the decoking operation terminates.

30. The process according to claim 28, wherein only one of components (iii), (iv), (v), and (vi) is present.

31. The process according to claim 28, wherein two of components (iii), (iv), (v), and (vi) are present.

32. The process according to claim 28, wherein three of components (iii), (iv), (v), and (vi) are present.

33. The process according to claim 28, wherein four components (iii), (iv), (v), and (vi) are present.

* * * * *